US010407287B2

(12) United States Patent
Shirota

(10) Patent No.: US 10,407,287 B2
(45) Date of Patent: Sep. 10, 2019

(54) CHAIN BLOCK

(71) Applicant: KITO CORPORATION, Nakakoma-gun, Yamanashi (JP)

(72) Inventor: Akinori Shirota, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 147 days.

(21) Appl. No.: 15/310,293

(22) PCT Filed: Apr. 30, 2015

(86) PCT No.: PCT/JP2015/063043
§ 371 (c)(1),
(2) Date: Nov. 10, 2016

(87) PCT Pub. No.: WO2015/174293
PCT Pub. Date: Nov. 19, 2015

(65) Prior Publication Data

US 2017/0174483 A1 Jun. 22, 2017

(30) Foreign Application Priority Data

May 16, 2014 (JP) ..... 2014-102822

(51) Int. Cl.
*B66D 3/16* (2006.01)
*B66D 5/14* (2006.01)

(52) U.S. Cl.
CPC ..... *B66D 3/16* (2013.01); *B66D 5/14* (2013.01); *B66D 2700/023* (2013.01); *B66D 2700/07* (2013.01)

(58) Field of Classification Search
CPC ... B66D 3/16; B66D 3/26; B66D 5/14; B66D 2700/023; B66D 2700/07; F16G 13/12; F16G 55/303
See application file for complete search history.

(56) References Cited

U.S. PATENT DOCUMENTS 2,623,731 A * 12/1952 Kamlukin ..... B66D 3/16 254/345
2,642,266 A 6/1953 Dotson
(Continued)

FOREIGN PATENT DOCUMENTS

CN 203461748 U 3/2014
JP 1975005359 U 1/1975
(Continued)

OTHER PUBLICATIONS

International Search Report corresponding to Application No. PCT/JP2015/063043; dated Aug. 18, 2015, with English translation.
(Continued)

*Primary Examiner* — Michael E Gallion
(74) *Attorney, Agent, or Firm* — Cantor Colburn LLP

(57) ABSTRACT

A chain block includes: a main body frame; and a gear cover that is attached to the main body frame to form an internal space sealed off from an outside between the gear cover and the main body frame, and rotatably supports one end side of a reduction gear member, wherein a gear-side frame part is provided with a bottom part and an outer peripheral wall part projecting from an outer peripheral edge portion of the bottom part, and an upper rib having both ends coupled to the outer peripheral wall part is provided at a portion of the gear-side frame on an upper side where an insertion hole and a link shaft are provided and on a side nearer a center of the internal space than is the outer peripheral wall part, and the upper rib is provided adjacent to the insertion hole and the link shaft.

8 Claims, 10 Drawing Sheets

(56) References Cited

U.S. PATENT DOCUMENTS

| | | | | | |
|---|---|---|---|---|---|
| 2,739,789 | A * | 3/1956 | Smith | B66D 3/16 | 192/16 |
| 3,894,720 | A * | 7/1975 | Koji | B66D 3/16 | 254/285 |
| 6,062,543 | A * | 5/2000 | Kobayasi | B66D 3/16 | 254/372 |
| 9,802,799 | B2 * | 10/2017 | Ishikawa | B66D 3/26 | |
| 2008/0105858 | A1 * | 5/2008 | Sakai | B66D 3/16 | 254/267 |
| 2009/0032787 | A1 * | 2/2009 | Xia | B66D 3/16 | 254/346 |
| 2015/0298946 | A1 * | 10/2015 | Kosuga | B66D 3/16 | 254/342 |
| 2015/0314998 | A1 * | 11/2015 | Ishikawa | B66D 3/16 | 254/358 |

FOREIGN PATENT DOCUMENTS

| | | | |
|---|---|---|---|
| JP | 2005112631 | A | 4/2005 |
| JP | 4693506 | B2 | 6/2011 |
| JP | 4698266 | B2 | 6/2011 |
| JP | 2014108840 | A | 6/2014 |
| TW | 515450 | U | 12/2002 |
| TW | I363740 | B | 5/2012 |
| WO | 2014084208 | A1 | 6/2014 |

OTHER PUBLICATIONS

TW Office Action corresponding to Application No. 104115330; dated May 8, 2018.

* cited by examiner

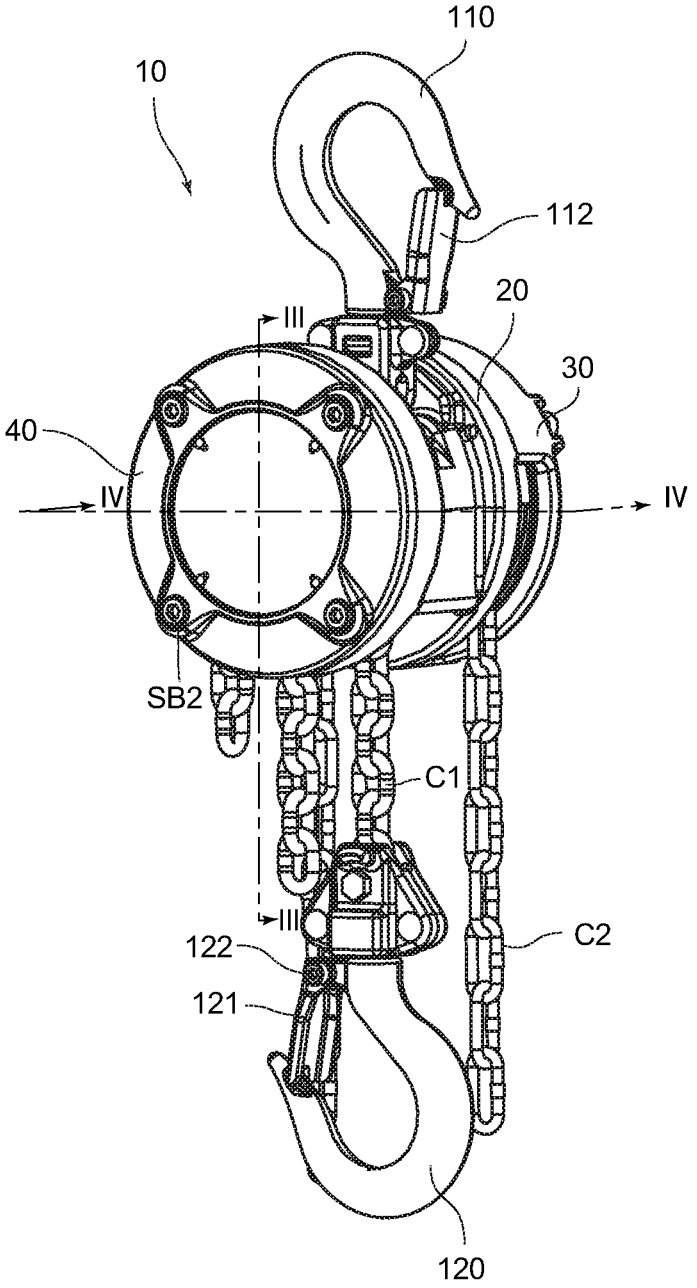
Fig.1
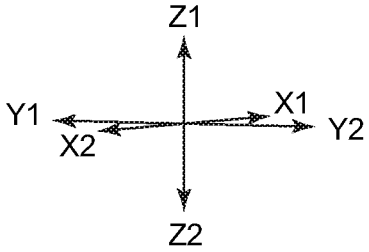

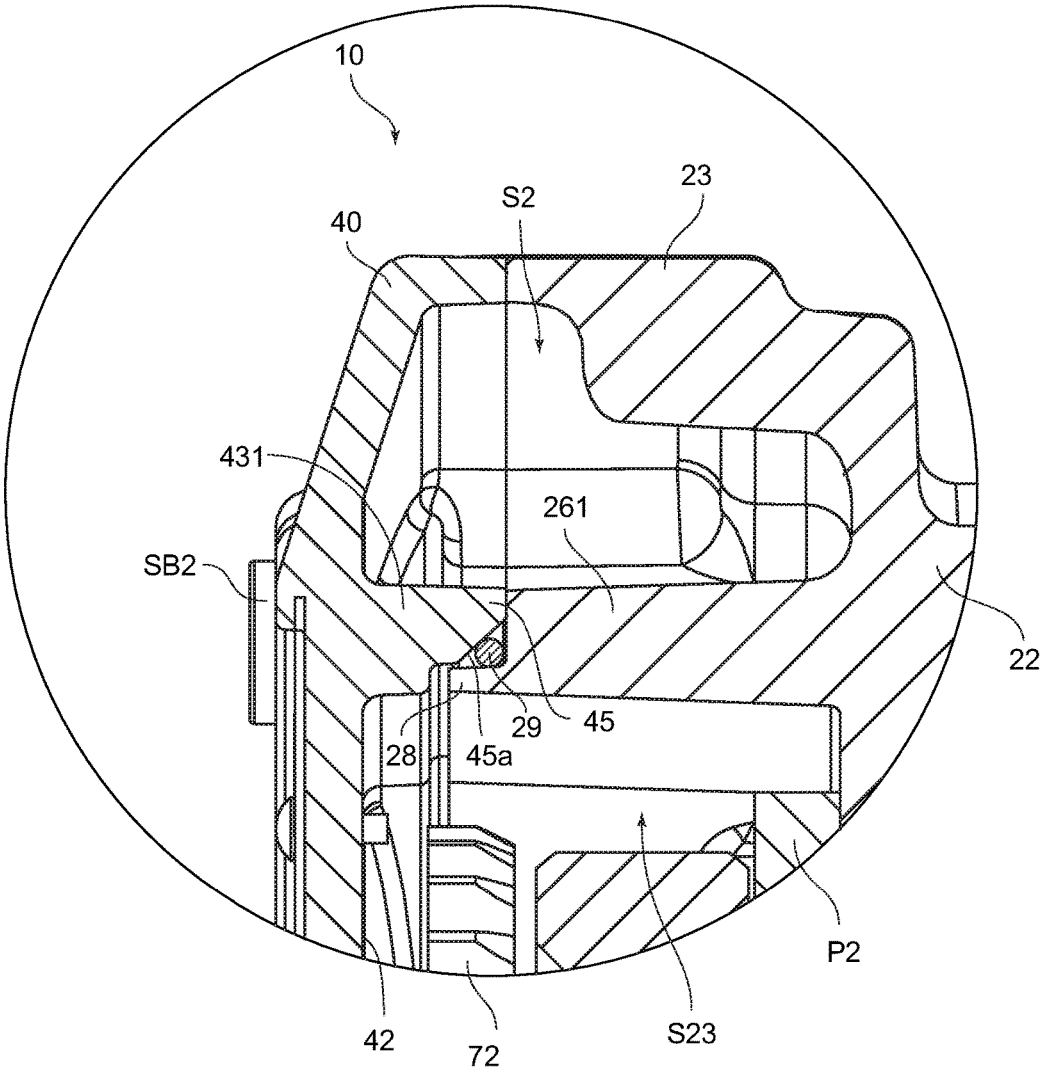
Fig.9
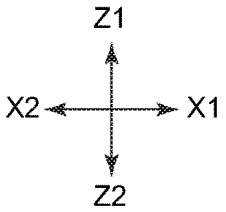

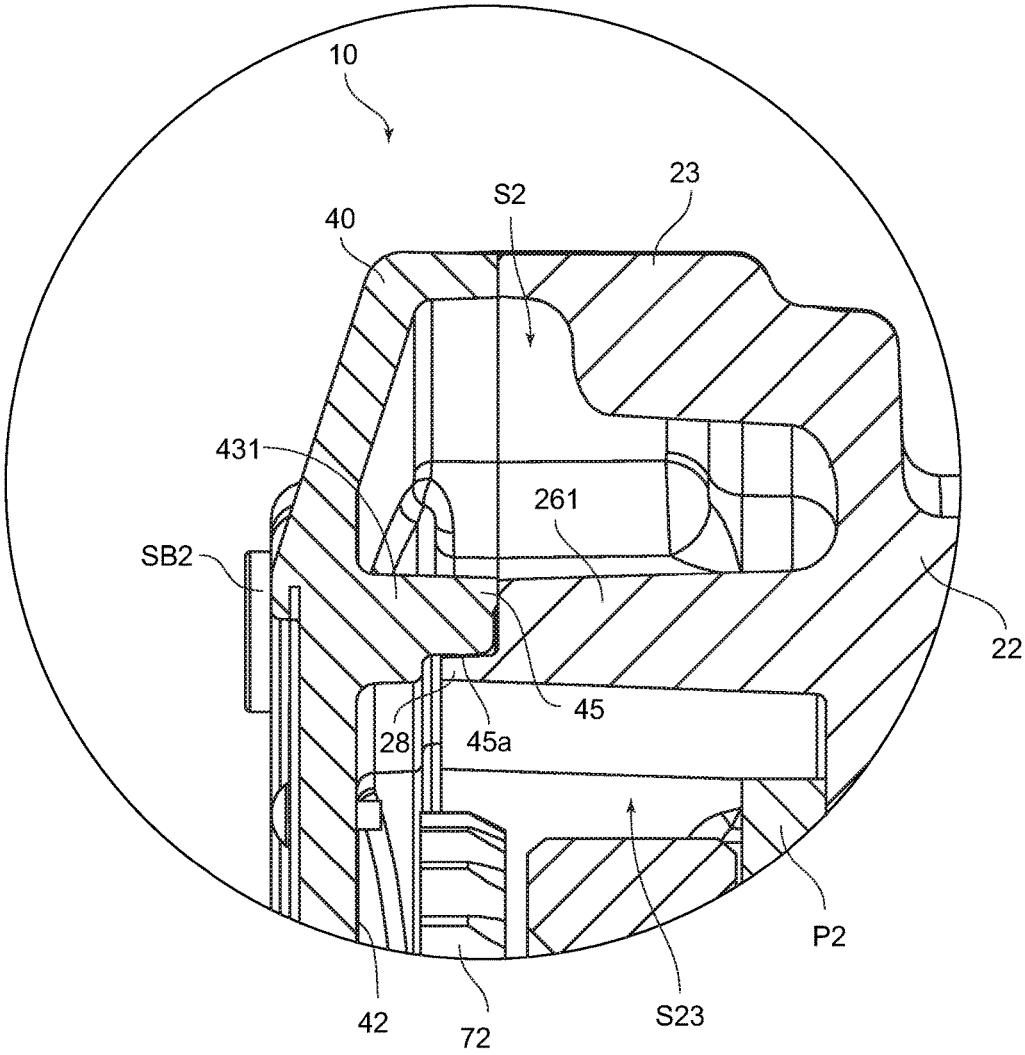
Fig.10
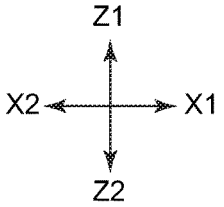

CHAIN BLOCK

CROSS REFERENCE TO RELATED APPLICATIONS

This is a U.S. national stage of application No. PCT/JP2015/063043, filed on Apr. 30, 2015. Priority under 35 U.S.C. § 119(a) and 35 U.S.C. § 365(b) is claimed from Japanese Patent Applications No. 2014-102822 filed on May 16, 2014, the disclosure of which is also incorporated herein by reference.

TECHNICAL FIELD

The present invention relates to a chain block used for an operation of hoisting a cargo.

BACKGROUND ART

Examples of a chain block that moves a cargo in the vertical direction include those having a main body frame formed by aluminum die-cast using an aluminum-based metal as disclosed in PTLs 1, 2. In the configurations illustrated in PTLs 1, 2, a reduction gear cover 4 is attached to a reduction-side frame 2*b* of a main body frame 2. This forms a gear housing space for housing the reduction gear.

CITATION LIST

Patent Literature

{PTL 1} JP 4693506 (refer to FIG. 5, FIG. 6 and so on)
{PTL 2} JP 4698266 (refer to FIG. 1 and so on)

SUMMARY OF INVENTION

Technical Problem

The configurations disclosed in PTLs 1, 2, however, have a following problem. The problem is that when a load acting on the main body frame 2 becomes larger, the main body frame 2 is deformed, resulting in shift of the position of the reduction gear from a desired position. In this case, the mesh state of the reduction gear changes to increase mechanical loss, bringing about a problem of a decrease in efficiency of the chain block. In particular, when load rating of the chain block is tried to increase, the change of the mesh state of the reduction gear due to the deformation of the main body frame 2 becomes relatively large, thus increasing the mechanical loss.

The present invention has been made under the above circumstances, and its object is to provide a chain block capable of improving the stiffness of a main body frame of the chain block and improving the positioning accuracy of a reduction gear.

Solution to Problem

To solve the above problem, according to first aspect of the present invention, a chain block capable of moving a cargo in a vertical direction by transmitting driving force of a handwheel through a drive shaft and a reduction gear member to a load sheave member so as to hoist and lower a load chain wound around the load sheave member, includes: a main body frame that has a gear-side frame part housing the reduction gear member and directly or indirectly supports one end side of the reduction gear member in a rotatable state; a gear cover that is attached to the main body frame via a fixing means to form an internal space sealed off from an outside between the gear cover and the main body frame, and rotatably supports the one end side of the reduction gear member; and an upper hook that is coupled to the gear-side frame part via a connecting means, for suspending the main body frame therefrom, wherein the gear-side frame part is provided with a bottom part and an outer peripheral wall part projecting from an outer peripheral edge portion of the bottom part, and wherein an upper rib having both ends coupled to the outer peripheral wall part is provided at a portion of the gear-side frame on an upper side where the connecting means is provided and on a side nearer a center of the internal space than is the outer peripheral wall part, and the upper rib is provided adjacent to the connecting means.

Further, in another aspect of the present invention, it is preferable in the above-described invention that the gear cover is attached to the main body frame via at least two fixing means on an upper side in the vertical direction in a suspending state, and two of the fixing means are provided adjacent to both end sides of the upper rib.

Further, in another aspect of the present invention, it is preferable in the above-described invention that a lower rib having both ends coupled to the outer peripheral wall part is provided at a portion of the gear-side frame on a lower side in the vertical direction distant from the connecting means in a suspending direction and on a side nearer the center of the internal space than is the outer peripheral wall part, and an inner peripheral wall part constituted of the upper rib, the lower rib, and the outer peripheral wall part located between the upper rib and the lower rib is provided in an elliptical shape or an oval shape in planar view.

Further, in another aspect of the present invention, it is preferable in the above-described invention that end surfaces on the gear cover side of the upper rib, the lower rib, and the outer peripheral wall part located between the upper rib and the lower rib constituting the inner peripheral wall part are provided to be flush with one another, a flange part projects from the end surfaces to the gear cover side, and the flange part is provided in an elliptical shape or an oval shape in planar view, the gear cover is provided with a lid-side upper rib abutting on the upper rib, a lid-side outer peripheral wall part abutting on the outer peripheral wall part, and a lid-side lower rib abutting on the lower rib, and the flange part is located on a side inner than is an inner wall surface of the lid-side inner peripheral wall part constituted of the lid-side upper rib, the lid-side lower rib, and the lid-side outer peripheral wall part located between the lid-side upper rib and the lid-side lower rib.

Further, in another aspect of the present invention, it is preferable in the above-described invention that an annular sealing member is arranged on an outer peripheral side of the flange part, and the sealing member is located between the flange part and the inner wall surface of the lid-side inner peripheral wall.

Advantageous Effects of Invention

According to the present invention, it becomes possible to improve the stiffness of a main body frame and improve the positioning accuracy of a reduction gear.

BRIEF DESCRIPTION OF DRAWINGS

FIG. 1 is a perspective view illustrating the external appearance of a chain block according to a first embodiment of the present invention;

FIG. 9 is a view illustrating the configuration of a chain block according to a second embodiment of the present invention, and is a cross-sectional view illustrating a state where the chain block is cut along the line III-III in FIG. 1; and FIG. 10 is a view illustrating the configuration of a chain block according to a third embodiment of the present invention, and is a cross-sectional view illustrating a state where the chain block is cut along the line III-III in FIG. 1.

DESCRIPTION OF EMBODIMENTS

Hereinafter, a chain block 10 according to a first embodiment of the present invention will be described based on the drawings.

<Regarding the Configuration of the Chain Block>

Figure 2:
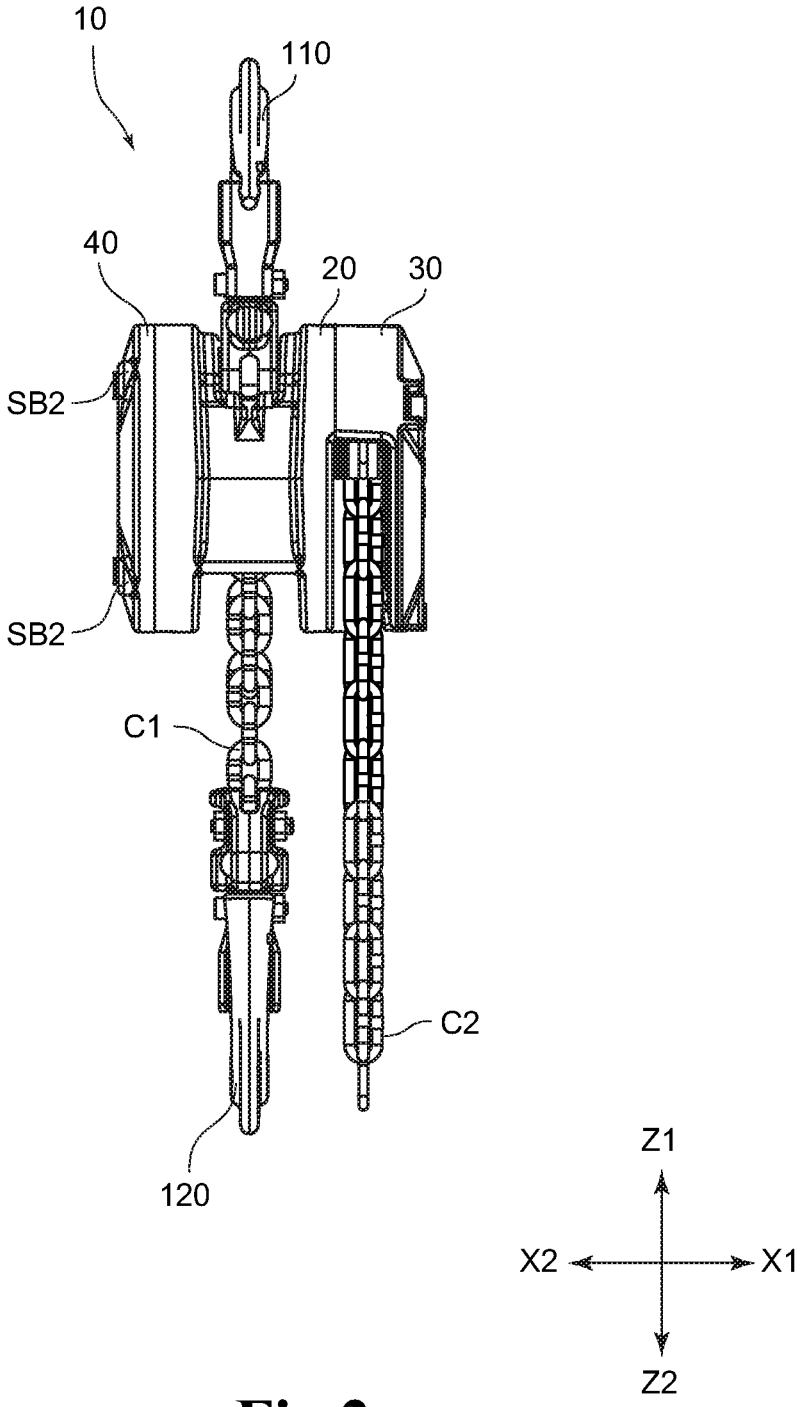
FIG. 2 is a side view illustrating the external appearance of the chain block illustrated in FIG. 1.
Figure 3:
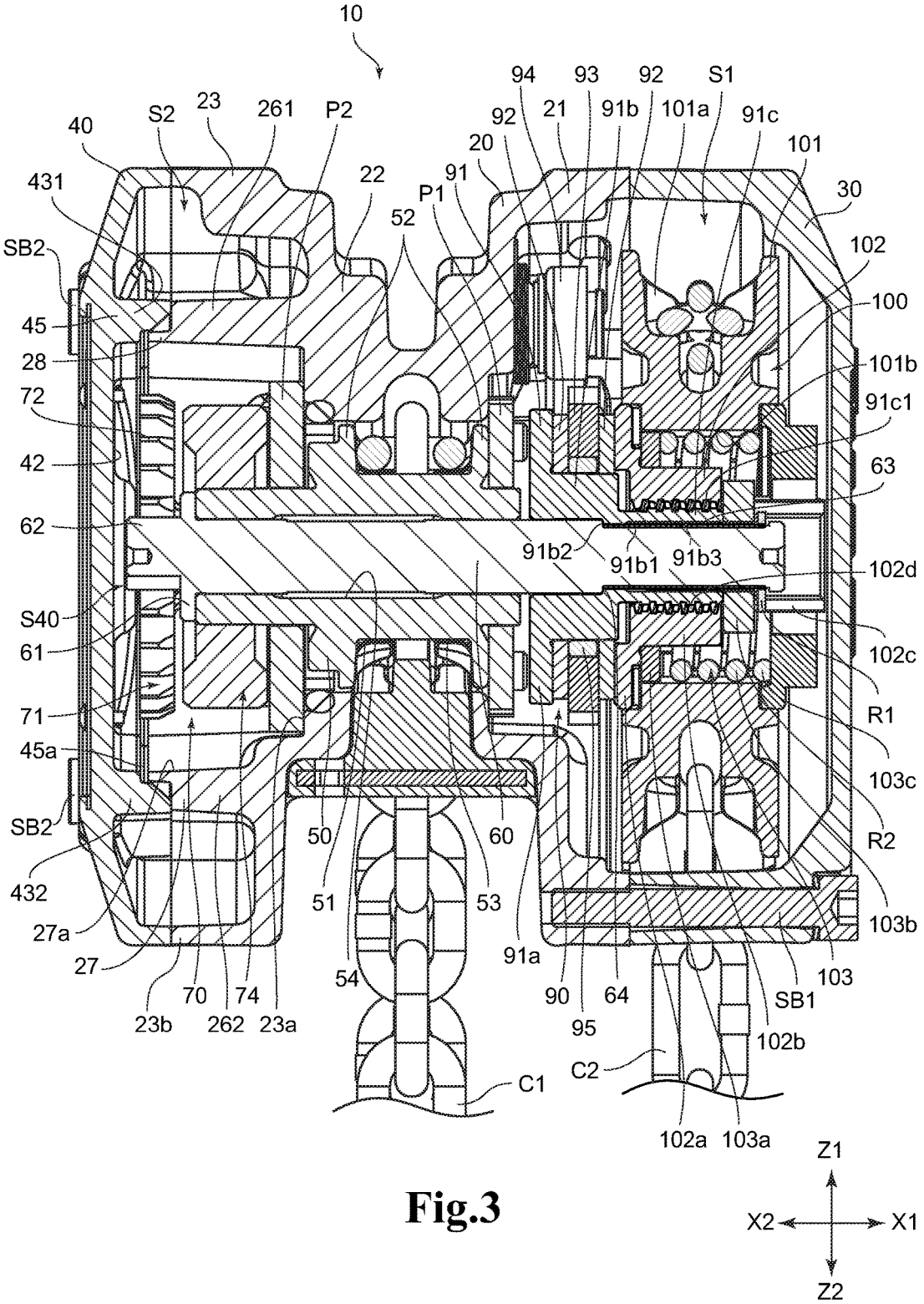
FIG. 3 is a cross-sectional view illustrating a state where the chain block is cut along a line III-III in FIG. 1.
Figure 4:
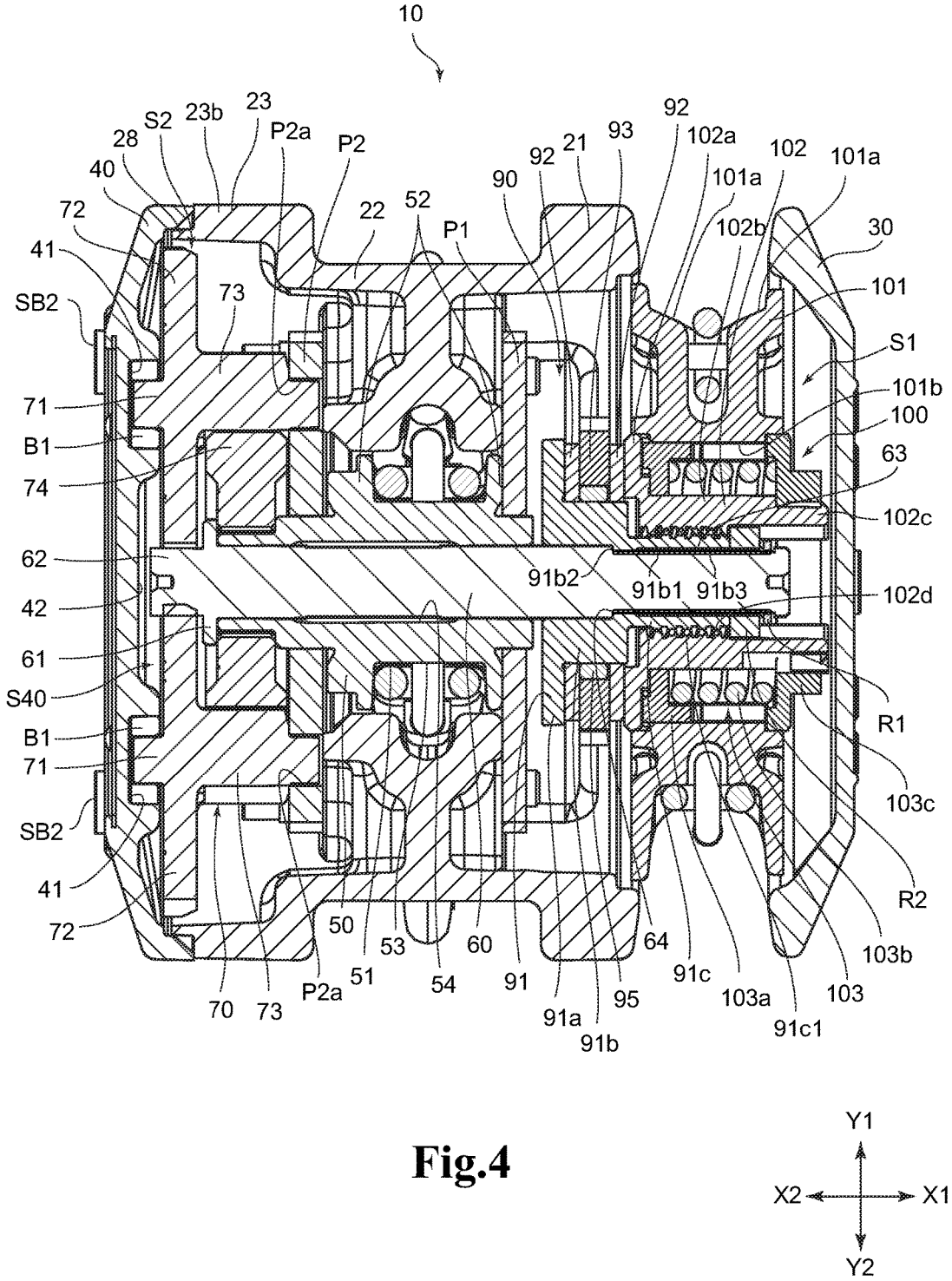
FIG. 4 is a cross-sectional view illustrating a state where the chain block is cut along a line IV-IV in FIG. 1.

FIG. 1 is a perspective view illustrating the external appearance of the chain block 10 according to the first embodiment. FIG. 2 is a side view illustrating the external appearance of the chain block 10 according to the first embodiment. FIG. 3 is a cross-sectional view illustrating a state where the chain block 10 is cut along a line III-III in FIG. 1. FIG. 4 is a cross-sectional view illustrating a state where the chain block 10 is cut along a line IV-IV in FIG. 1.

Note that the drawings including FIG. 1 and FIG. 2 illustrate the external appearance and the configuration of the chain block 10 according to the first embodiment, and most of the external appearance and the configuration are common also in chain blocks 10 according to later-described other embodiments (a second embodiment and a third embodiment). Therefore, the drawings including FIG. 1 and FIG. 2 are assumed to be common drawings in the other embodiments unless there are portions different from those of the chain blocks 10 according to the other embodiments.

Note that in the following description, an explanation will be given using an XYZ rectangular coordinate system. An X-direction in the rectangular coordinate system is assumed to be an axial direction of a drive shaft 60, an X1 side is assumed to be a side to which a later-described wheel cover 30 is attached, and an X2 side is assumed to be a side, opposite to the X1 side, to which a gear cover 40 is attached. Further, a Z-direction is assumed to be a vertical direction (suspending direction; hoisting/lowering direction) in a suspending state of the chain block 10, a Z1 side is assumed to be an upper side in the suspending state, and a Z2 side is assumed to be a lower side in the suspending state. Further, a Y-direction is assumed to be a direction (a width direction) orthogonal to the X- and Z-directions, a Y1 side is assumed to be the left side in FIG. 1, and a Y2 side is assumed to be the right side opposite to the Y1 side.

As illustrated in FIG. 1 to FIG. 4, the chain block 10 includes a main body frame 20, the wheel cover 30, the gear cover 40, a load sheave hollow shaft 50, the drive shaft 60, a reduction mechanism 70, a brake mechanism 90, a hand-wheel mechanism 100, an upper hook 110, a lower hook 120 and so on. Hereinafter, the members and so on will be described, and the details of the configuration on a gear-side frame part 23 side of the main body frame 20 and the configuration of the gear cover 40 will then be described.

As illustrated in FIG. 1 and FIG. 2, the main body frame 20 is provided to have a circular shape as a shape in front view. The main body frame 20 is formed, for example, by aluminum die-cast using an aluminum-based metal. The main body frame 20, however, may be formed using a meal other than the aluminum-based metal as long as it has stiffness with respect to a load. Further, the main body frame 20 is preferably formed by aluminum die-cast, but may be formed by machining at least a part thereof or may be formed by attaching others member by welding or another fixing method.

As illustrated in FIG. 3 and FIG. 4, the main body frame 20 is provided with a wheel-side frame part 21, a coupling frame part 22, and the gear-side frame part 23. Further, to the wheel-side frame part 21, the wheel cover 30 is fixed by bolts SB1 (refer to FIG. 3). Further, to the gear-side frame part 23, the gear cover 40 is fixed by bolts SB2 (corresponding to fixing means). To an upper portion in the suspending direction of the coupling frame part 22 where a load sheave 51 is housed, the upper hook 110 is swingably connected to the main body frame 20 by a link shaft 111 (refer to FIG. 5) having both ends supported by the wheel-side frame part 21 and the gear-side frame part 23. The wheel cover 30 and the gear cover 40 are individually attached to the main body frame 20, whereby internal spaces S1, S2 are formed respectively, various members are housed in the internal spaces S1, S2, and the internal space S2 is blocked against the outside to prevent a lubricating oil from leaking out of it and prevent dust, rainwater and the like from entering it.

Further, the internal space S1 located inside the wheel-side frame part 21 is partitioned from the inner side of the coupling frame part 22 by a bearing plate P1. Further, the internal space S2 located inside the gear-side frame part 23 is partitioned from the inner side of the coupling frame part 22 by a bearing plate P2.

On the bearing plates P1, P2, the load sheave hollow shaft 50 is rotatably supported. The load sheave hollow shaft 50 has a pair of flange parts 52 which constitute the load sheave 51, and a chain pocket 53 which constitutes the load sheave 51 is provided between the pair of flange parts 52.

Further, the load sheave hollow shaft 50 is provided with a hollow hole 54, and the drive shaft 60 is inserted into the hollow hole 54. Note that at a portion, of the drive shaft 60, protruding to the X2 side from the hollow hole 54, a flange part 61 which restricts movement of the drive shaft 60 to the X1 side is provided. On the other hand, a snap ring R1 is attached to one end side (X1 side) of the drive shaft 60, and the snap ring R1 is adjacent, on the X2 side, to a ring member R2. The ring member R2 inhibits advancement of a later-described female thread member 102 to the X1 side. Further, at an end portion of the drive shaft 60 on a side nearer the X2 than is the flange part 61, a pinion gear 62 is provided. The pinion gear 62 meshes with large-diameter gears 72 which are a pair of reduction gear members 71 constituting the reduction mechanism 70.

Note that one end side (X1 side) of each of the reduction gear members 71 is rotatably supported by a shaft hole P2*a* (refer to FIG. 4) of the above-described bearing plate P2, and another end side thereof is rotatably supported by the above-described gear cover 40. Further, the gear cover 40 is provided with recessed bearing fixing holes 41, and bearings B1 are fitted in the bearing fixing holes 41, and the other end side (X2 side) of each of the reduction gear members 71 is rotatably supported by the bearing B1.

Further, at portions of the pair of reduction gear members 71 on a side nearer X1 than are the large-diameter gears 72 on a side nearer X1 than are the large-diameter gears 72, small-diameter gears 73 are provided. The small-diameter gears 73 mesh with a load gear 74. The load gear 74 is held on the other end side (X2 side) of the load sheave hollow shaft 50, for example, in a key-coupling state or a spline coupling state, so that the gear 74 can transmit torque to the load sheave hollow shaft 50.

Further, at a portion of the drive shaft 60 nearer one end (nearer X1) than is the bearing plate P1, the brake mechanism 90 is arranged, and at a portion nearer the one end (nearer X1) than is the brake mechanism 90, the handwheel mechanism 100 is arranged. Further, on the handwheel mechanism 100 side of the drive shaft 60, a spline part 63 is provided. The spline part 63 is a portion into which a spline part 91*b*3 of a later-described brake receiver 91 is fitted. Note that at an end portion on the X2 side of the spline part 63, a stepped part 64 is provided, and the later-described brake receiver 91 is locked at the stepped part 64.

The brake mechanism 90 has the brake receiver 91, brake discs 92, a ratchet wheel 93, a pawl member 94, a bush 95 and so on, as main components. The brake receiver 91 has a flange part 91*a*, a hollow boss part 91*b*, and a cylindrical tip part 91*c*. The flange part 91*a* is a portion that is provided to be larger in diameter than the hollow boss part 91*b* and can receive the later-described brake discs 92.

The hollow boss part 91*b* is located on a side nearer the handwheel mechanism 100 (X1 side) than is the flange part 91*a*, and rotatably supports the ratchet wheel 93 via the later-described bush 95. The brake receiver 91 has a stepped insertion hole 91*b*1. At a portion of the stepped insertion hole 91*b*1 on a side nearer the one end (X1 side) than is a stepped part 91*b*2, the spline part 91*b*3 smaller in diameter than the stepped part 91*b*2 is provided, and the spline part 63 is fitted in the above-described spline part 91*b*3.

Further, the cylindrical tip part 91*c* is located on a side nearer the one end side (X1 side) than is the hollow boss part 91*b*. On an outer peripheral side of the cylindrical tip part 91*c*, a multiple male thread part 91*c*1 is provided, and a multiple female thread part 102*d* of the female thread member 102 of the handwheel mechanism 100 is screwed into the male thread part 91*c*1.

Further, between the flange part 91*a* and the ratchet wheel 93 and between the female thread member 102 and the ratchet wheel 93, the brake discs 92, 92 are rotatably supported by the hollow boss part 91*b*, respectively. A tip of the pawl member 94 (refer to FIG. 3) meshes with the ratchet wheel 93, and the mesh constitutes a ratchet mechanism that prevents rotation in a lowering direction of the ratchet wheel 93.

When a load acts on the drive shaft 60 in the lowering direction, the female thread member 102 presses the brake discs 92 by a screw clamping action of the female thread member 102 and the brake receiver 91 so as to cause brake force to act on the brake receiver 91 with respect to the ratchet wheel 93 which is prevented from rotating in the lowering direction, as a result the turn of the drive shaft 60 in the lowering direction is suppressed. When the handwheel mechanism 100 is turned in a hoisting direction, the female thread member 102, the brake discs 92, 92, the ratchet wheel 93, and the brake receiver 91 integrally turn the drive shaft 60, because the ratchet wheel 93 is rotatable in the hoisting direction, to hoist a load chain C1. When the handwheel mechanism 100 is turned in the lowering direction, the screw clamping action of the female thread member 102 and the brake receiver 91 is relaxed to release the brake force with respect to the ratchet wheel 93 according to the rotation amount of the handwheel mechanism 100, and the brake receiver 91 and the drive shaft 60 therefore turn in the lowering direction.

Further, the brake disc 92 on the X2 side is located between the flange part 91*a* and the later-described ratchet wheel 93 and applies large frictional force between the flange part 91*a* and the later-described ratchet wheel 93 when it is brought into pressure contact with them from the female thread member 102 side, and the large frictional force brings the brake receiver 91 into a state of integrally rotating with the ratchet wheel 93. Note that the brake disc 92 is arranged also between the ratchet wheel 93 and the female thread member 102, and applies large frictional force between the ratchet wheel 93 and the female thread member 102 by pressure contact with them from the female thread member 102 side. When the handwheel mechanism 100 is rotated, the handwheel mechanism 100 and the ratchet wheel 93 are brought into an integrally rotating state by the large frictional force.

As illustrated in FIG. 3 and FIG. 4, the bush 95 is provided on the outer peripheral side of the hollow boss part 91*b* of the brake receiver 91, and the ratchet wheel 93 is provided on the outer peripheral side of the bush 95. Thus, the ratchet wheel 93 is provided to be freely rotatable with respect to the brake receiver 91. Note that the tip of the pawl member 94 (refer to FIG. 3) meshes with the ratchet wheel 93, and the mesh constitutes the ratchet mechanism which prevents the reverse rotation (rotation in the hoisting direction) of the ratchet wheel 93.

Next, the handwheel mechanism 100 will be described. The handwheel mechanism 100 has a handwheel 101, the female thread member 102, and a torque limiter mechanism 103 as main components. Note that the female thread member 102 is also a component of the brake mechanism 90. The handwheel 101 is a ring-shaped member, and the female thread member 102 and the torque limiter mechanism 103 are arranged in an inner peripheral hole 101*b* of the ring-shaped handwheel 101.

Further, on the outer peripheral side of the handwheel 101, a chain pocket 101*a* is provided. The chain pocket 101*a* is a portion into which a metal ring C2*a* of a handchain C2 is fitted, and has a horizontal pocket (not illustrated) into which the metal ring C2*a* is fitted in a state where the flat direction of the metal ring C2*a* is parallel to the axial direction, and a vertical pocket (not illustrated) which is in a groove shape deeper than the horizontal pocket and into which the metal ring C2*a* is fitted in a state where the flat direction of the metal ring C2*a* intersects with the axial direction. When the handchain C2 fitted in the chain pocket 101*a* is pulled, the handwheel 101 rotates.

The female thread member 102 has a flange part 102*a*, a cylindrical part 102*b*, and a projecting tip part 102*c*. The flange part 102*a* is a portion provided to be larger in diameter than the cylindrical part 102*b*, and a portion receiving a movable pawl 103*a* of the torque limiter mechanism 103. The flange part 102*a* is provided with a recessed portion (not illustrated) into which a projecting portion (not illustrated) of the movable pawl 103*a* is fitted, and the recessed portion and the projecting portion are provided with tapered wall portions which are slightly inclined with respect to the axial direction (X-direction). Therefore, normally, the projecting portion is fitted in the recessed portion, but when extremely large torque acts on the handwheel 101, the projecting portion of the movable pawl 103*a* comes off the recessed portion against biasing force of a spring member 103*b* of the torque limiter mechanism 103, whereby the torque limiter mechanism 103 fulfills its function.

Besides, the cylindrical part 102*b* is located on a side nearer the one end side (X1 side) than is the flange part 102*a*. On an inner peripheral side of the cylindrical part 102*b*, the female thread part 102*d* is provided, and the above-described male thread part 91*c*1 is screwed into the female thread part 102*d*. Further, the projecting tip part 102*c* is provided on a side nearer the one end side (X1 side) than is the cylindrical part 102*b*. The tip side (an end portion on the X1 side) of projecting tip part 102*c* is closely opposed to a lid part 31 of the wheel cover 30. Note that the projecting tip part 102*c* is provided not over the whole circumference in the circumferential direction unlike the cylindrical part 102*b*, but is provided intermittently in the circumferential direction. A projecting part of the ring member R2 projects at a cutout portion to restrict the relative rotation of the female thread member 102 with respect to the drive shaft 60 and the brake receiver 91 into a fixed range. Note that a spline part that engages with the spline part 63 of the drive shaft 60 is formed in the inner periphery of the ring member R2.

Besides, the torque limiter mechanism 103 has the movable pawl 103*a*, the spring member 103*b*, and a pressing member 103*c*. The movable pawl 103*a* of them has a portion provided in a ring shape. A surface on the other side (a surface on the X2 side) of the ring-shaped portion of the movable pawl 103*a* abuts on the flange part 102*a* of the female thread member 102, and a surface on the one side (a surface on the X1 side) thereof abuts on the spring member 103*b*. Note that the surface on the other side (the surface on the X2 side) of the ring-shaped portion of the movable pawl 103*a* is provided with a not-illustrated projecting portion, and the projecting portion is fitted in the recessed portion of the flange part 102*a*.

Further, the spring member 103*b* is located between the movable pawl 103*a* and the pressing member 103*c*, and applies biasing force in a direction of separating the movable pawl 103*a* and the pressing member 103*c* from each other. Further, a surface on the other side (a surface on the X2 side) of the pressing member 103*c* abuts on the spring member 103*b*. The position in the axial direction (X-direction) of the pressing member 103*c* is fixed with respect to the handwheel 101 or the female thread member 102. Therefore, the pressing member 103*c* receives the biasing force of the spring member 103*b* and thereby applies biasing force in a direction of pressing the movable pawl 103*a* to the flange part 102*a* of the female thread member 102. When extremely large torque acts on the handwheel 101, the projecting portion of the movable pawl 103*a* comes off the recessed portion of the flange part 102*a* of the female thread member 102 against the biasing force of the spring member 103*b*. This enables the torque limiter mechanism 103 to fulfill its function.

Figure 5:
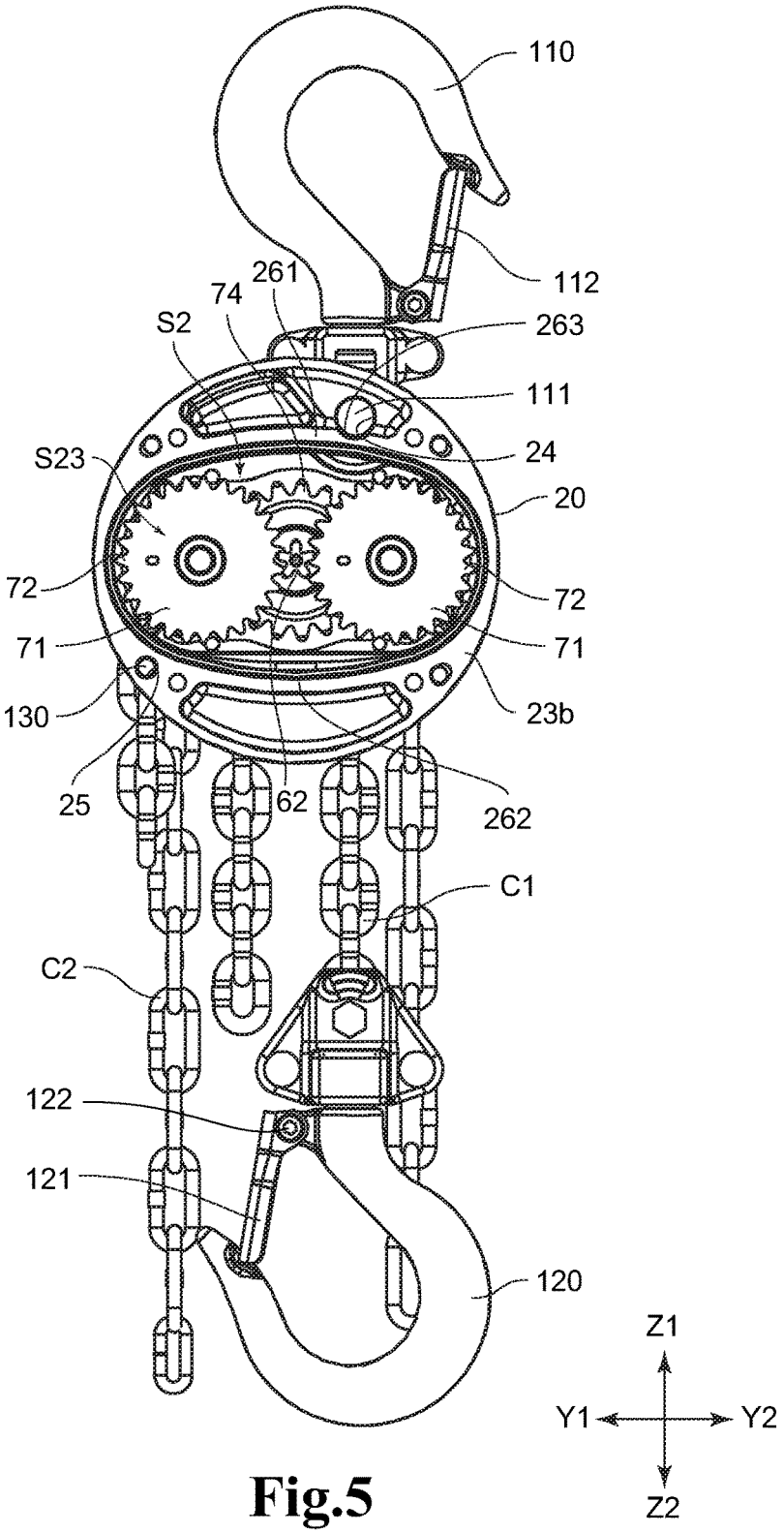
FIG. 5 is a front view illustrating a state where a gear cover of the chain block illustrated in FIG. 1 is removed.

Subsequently, the upper hook 110 will be described. The upper hook 110 is a hooking means for attachably/detachably suspending the chain block main body from an engaging member of a structure or a trolley of a crane. FIG. 5 is a front view illustrating a state where the gear cover 50 of the chain block 10 is removed. As illustrated in FIG. 5, the upper hook 110 is attached to the main body frame 20 via the link shaft 111. Therefore, the main body frame 20 is provided with an insertion hole 24 for inserting the link shaft 111 thereinto. The upper hook 110 is attached, in a swingable manner, to the link shaft 111. To the upper hook 110, a hook latch 112 is attached, which is biased in a closing direction by a not-illustrated biasing means. Note that the link shaft 111 corresponds to a connecting means, and the insertion hole 24 into which the link shaft 111 is inserted may be regarded as corresponding to the connecting means.

Next, the lower hook 120 will be described. The lower hook 120 is a portion on which a cargo is hooked, and the lower hook 120 is attached to an end portion side opposite to a side to which a later-described fastening shaft 130 of the load chain C1 is attached. To the lower hook 120, a lever 121 is attached for preventing the cargo attached to the lower hook 120 from coming off it. The lever 121 has one end side located on the upper side (Z1 side), and is provided to be pivotable with a pivot shaft 122 on the one end side as a pivot. Further, the other end side of the lever 121 is located on the lower side (Z2 side), and is provided to abut on an inner periphery at the tip side of the lower hook 120.

The lever 121 is provided such that its other end side abuts on the inner periphery on the tip side of the lower hook 120 at all times because of the biasing force of a not-illustrated spring acting thereon. This can maintain the closed state of the lever 121 in a state where no external force acts on the lever 121, thereby making it possible to prevent the lever 121 from opening and allowing the cargo to fall.

Note that an end portion of the load chain C1 on a side opposite to the side to which the lower hook 120 is attached, is attached to the main body frame 20 via the fastening shaft 130. The fastening shaft 130 is inserted into a shaft hole 25 of the main body frame 20, and fixed to the main body frame 20 by screwing, or other means. The load chain C1 is configured to be prevented from coming off the main body frame 20 via the fastening shaft 130.

<Regarding the Configuration on the Gear-Side Frame Part 23 Side of the Main Body Frame 20>

Subsequently, the configuration on the gear-side frame part 23 side of the main body frame 20 will be described below.

Figure 6:
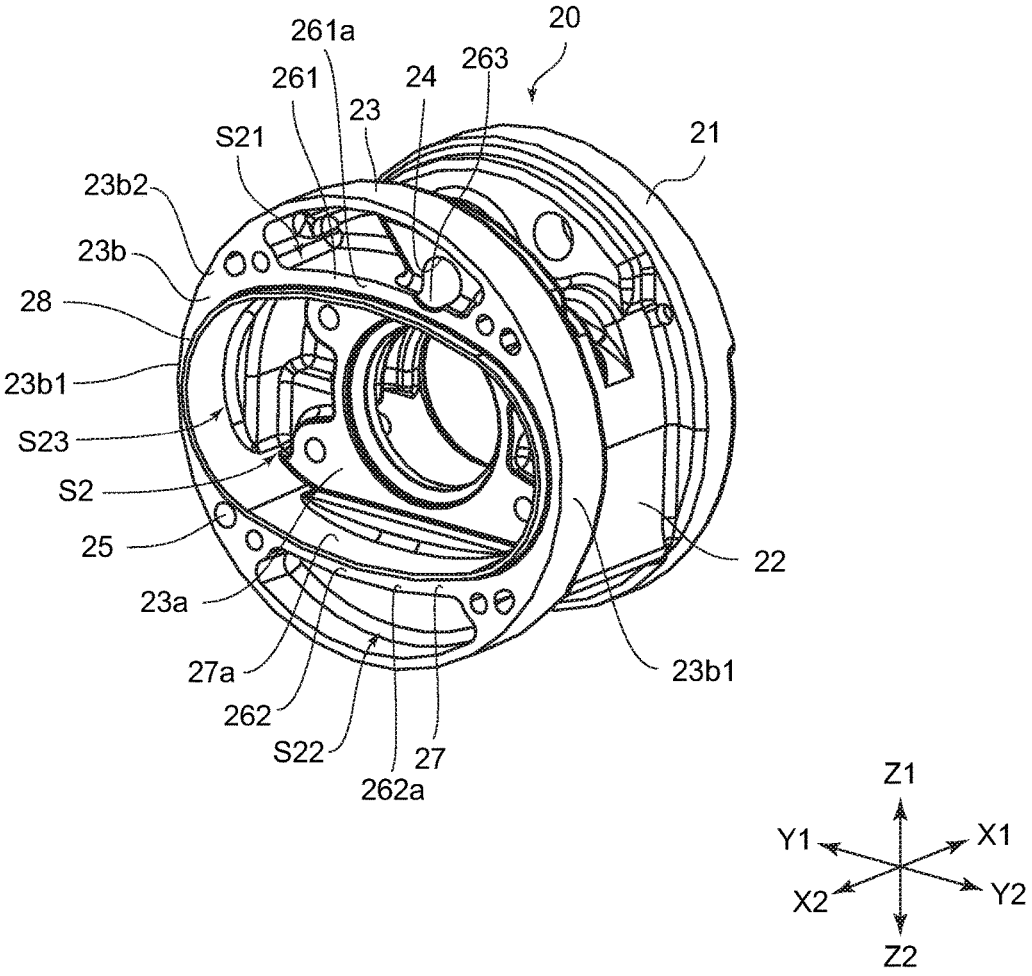
FIG. 6 is a perspective view illustrating the main body frame illustrated in FIG. 1 viewed from a gear-side frame part side.
Figure 7:
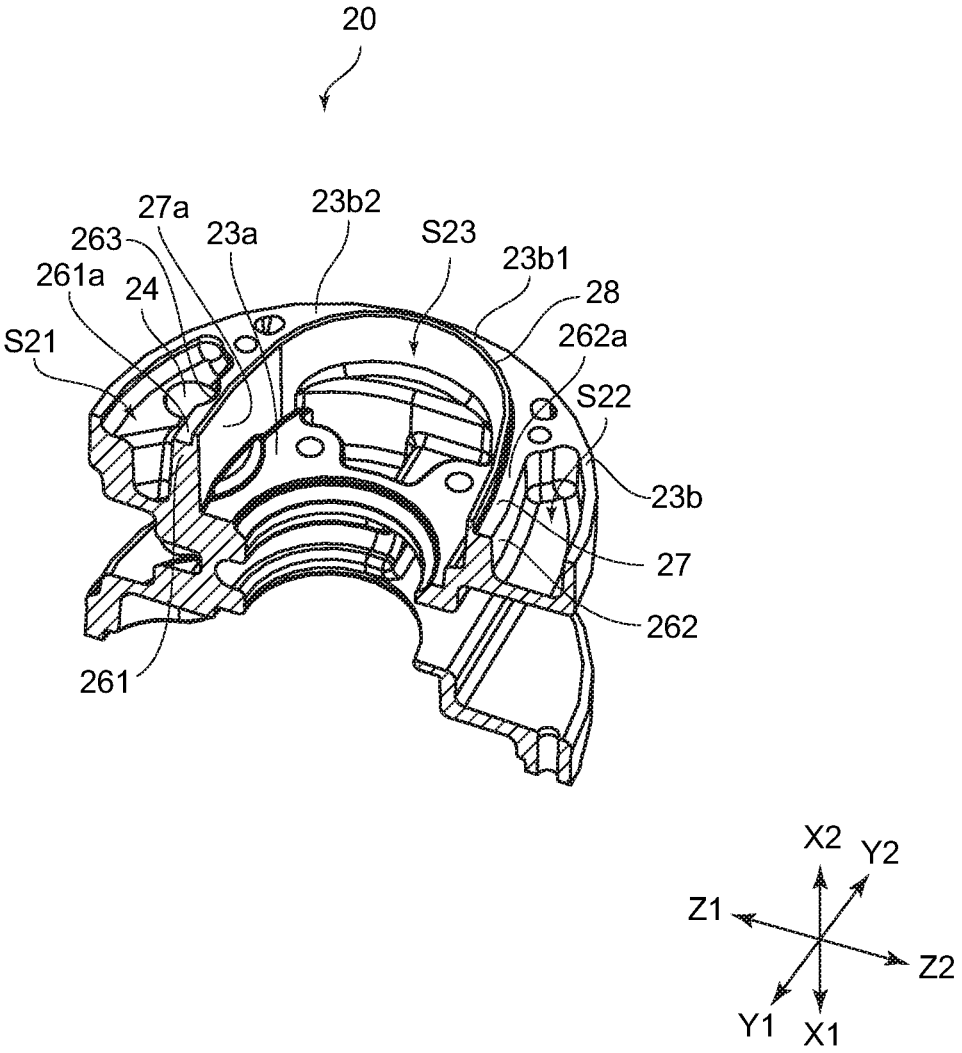
FIG. 7 is a half cross-sectional and perspective view illustrating main body frame illustrated in FIG. 1 viewed from a gear-side frame part.

FIG. 6 is a perspective view illustrating a state of the main body frame 20 viewed from the gear-side frame part 23 side. Besides, FIG. 7 is a half cross-sectional view illustrating a state of the main body frame 20 viewed from the gear-side frame part 23. As illustrated in FIG. 5 to FIG. 7, the gear-side frame part 23 has a bottom part 23*a*, and the bottom part 23*a* is located on the coupling frame part 22 side. From an outer peripheral edge portion of the bottom part 23*a*, an outer peripheral wall part 23*b* projects to the other end side (X2 side). In the gear-side frame part 23, the internal space S2 isolated from the outside is formed by surrounding it by the bottom part 23*a* and the circular outer peripheral wall part 23*b* and attaching the gear cover 40 thereto.

Further, from the bottom part 23*a*, an upper rib 261 and a lower rib 262 project to the other side (X2 side). The upper rib 261 is located on a side nearer an inner periphery (lower side; Z2 side) than is the outer peripheral wall part 23*b* on the upper side (Z1 side). Similarly, the lower rib 262 is located on a side nearer an inner periphery (upper side; Z1 side) than is the outer peripheral wall part 23*b* on the lower side (Z2 side).

The upper rib 261 is provided to be curved so as to project upward. However, the curvature of the upper rib 261 is provided to be smaller than that of the outer peripheral wall part 23*b* on the upper side (Z1 side). Therefore, the outer peripheral wall part 23*b* on the upper side (Z1 side) and the upper rib 261 form a relatively small almost falcate space part (an upper space part S21). Further, the upper rib 261 is provided to be adjacent to the insertion hole 24. In other words, when the link shaft 111 is inserted into the insertion hole 24, the link shaft 111 is in a state of existing adjacent to the upper rib 261. Further, the insertion hole 24 has an insertion opening part in the upper space part S21 so that the insertion and removal of the link shaft 111 is possible in a state where the gear cover 40 is removed. In FIG. 5, a recessed part 263 formed in a wall portion on the upper space part S21 side of the upper rib 261 is formed continuously in the axial direction of the insertion hole 24. The link shaft 111 can be guided along the recessed part 263 and inserted into the insertion hole 24.

The lower rib 262 is similarly provided to be curved so as to project downward. Further, the curvature of the lower rib 262 is provided to be smaller than that of the outer peripheral wall part 23*b* on the lower side (Z2 side). Therefore, the outer peripheral wall part 23*b* on the lower side (Z2 side) and the lower rib 262 form a relatively small almost falcate space part (a lower space part S22).

Here, in this embodiment, the upper rib 261, the lower rib 262, and the outer peripheral wall part 23*b* located at the lateral side (supposed to be an outer peripheral wall part 23*b*1) form an inner peripheral wall part 27 having an elliptical shape as a shape in front view, and the inner side of the inner peripheral wall part 27 is a gear housing space part S23. More specifically, the inner peripheral wall part 27 constituting the gear housing space part S23 is provided to have an elliptical shape as a shape in front view. In other words, an inner wall surface 27*a* of the inner peripheral wall part 27 has an elliptical contour formed as a shape in front view.

To form such an elliptical shape,
the outer peripheral wall part 23*b*1 located at the lateral side is provided to have a portion intersecting a plane including the center axis of the drive shaft 60 in the XY plane and the portion is smallest in thickness, and the outer peripheral wall part 23*b*1 is provided to be larger in thickness as it separates in the vertical direction from the intersecting portion. With such a thickness configuration, the outer peripheral wall part 23*b*1 is configured to serve also as the inner peripheral wall part 27.

Here, an end surface 23*b*2 located on the other end side (X2 side) of the outer peripheral wall part 23*b* is provided to be flash with an end surface 261*a* located on the other end side (X2 side) of the upper rib 261 and an end surface 262*a* located on the other end side (X2 side) of the lower rib 262. In this embodiment, however, a flange part 28 having an elliptical shape as a shape in front view projects from the end surface 261*a*, the end surface 262*a*, and the end surface 23*b*2 of the outer peripheral wall part 23*b*1. The flange part 28 is provided to be thinner than the upper rib 261, the lower rib 262, and the outer peripheral wall part 23*b*.

The flange part 28 is made to be capable of abutting on an inner wall surface 45*a* of an inner peripheral wall part 45 of the gear cover 40. Thus, the position in the rotation direction of the gear cover 40 with respect to the main body frame 20 is fixed.

<Regarding the Configuration of the Gear Cover 40>

Figure 8:
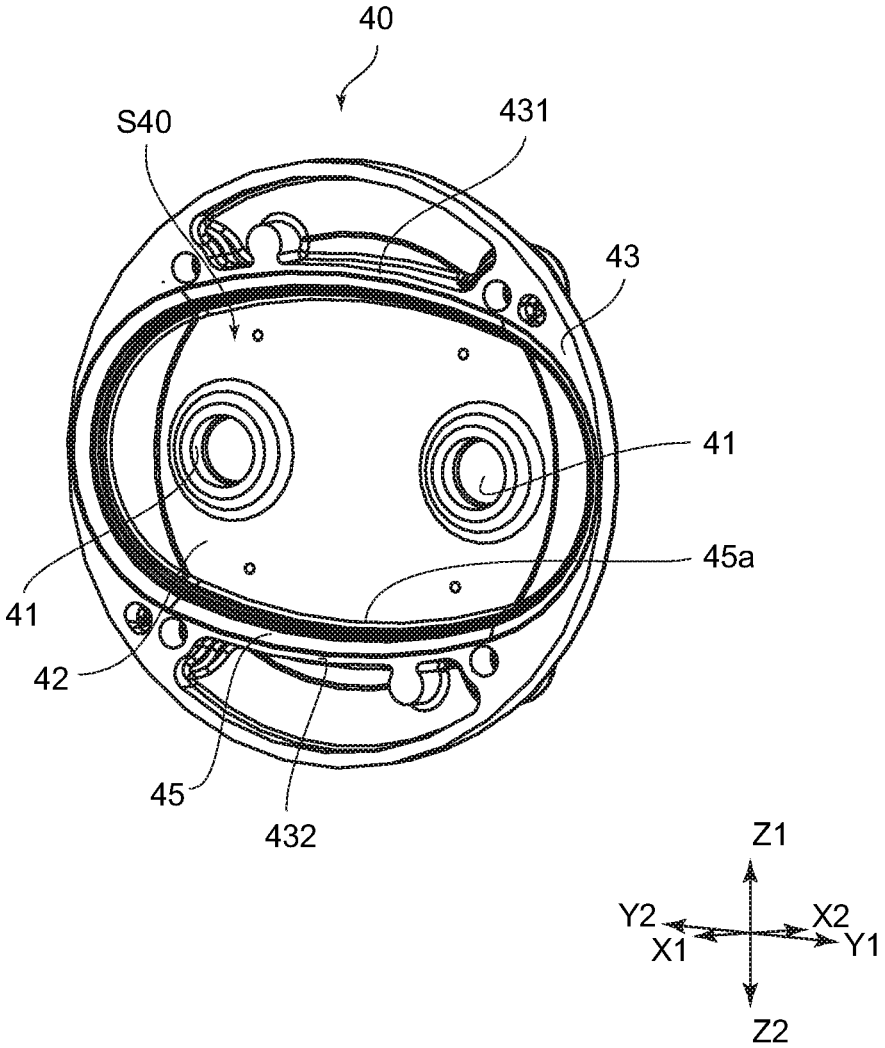
FIG. 8 is a perspective view illustrating the configuration of the gear cover illustrated in FIG. 1.

Next, the gear cover 40 will be described. FIG. 8 is a perspective view illustrating the configuration of the gear cover 40. As illustrated in FIG. 8, also in the gear cover 40, a lid-side bottom part 42 similar to the above-describe upper rib 261 exists, and a lid-side outer peripheral wall part 43 exists. However, the height of the lid-side outer peripheral wall part 43 from the lid-side bottom part 42 is provided to be lower than the height of the outer peripheral wall part 23*b* from the bottom part 23*a*. Further, the lid-side bottom part 42 is provided with the bearing fixing holes 41 into which the above-described bearings B1 are fitted.

The gear cover 40 is also provided with a lid-side upper rib 431 and a lid-side lower rib 432. The lid-side upper rib 431, the lid-side lower rib 432, and the lid-side outer peripheral wall part 43 located at the lateral side (supposed to be a lid-side outer peripheral wall part 43*a*) form the lid-side inner peripheral wall part 45 having an elliptical shape as a shape in front view, and in the inner side of the lid-side inner peripheral wall part 45, a lid-side space part S40 is formed. Note that the lid-side inner peripheral wall part 45 constituting the lid-side space part S40 is provided also to have an elliptical shape as a shape in front view. In other words, the inner wall surface 45*a* of the lid-side inner peripheral wall part 45 has an elliptical contour formed as a shape in front view.

Here, on the inner wall surface 45*a* side of the lid-side inner peripheral wall part 45, the above-described flange part 28 is located. Thus, if the gear cover 40 tries to rotate with respect to the main body frame 20, the inner wall surface 45*a* of the lid-side inner peripheral wall part 45 abuts on the flange part 28 and thereby disables the rotation of the gear cover 40 with respect to the main body frame 20. In other words, the lid-side inner peripheral wall part 45 has a function of positioning in the rotation direction and preventing rotation with respect to the main body frame 20.

Note that a sealing member such as an O-ring may be arranged on the outer peripheral side of the flange part 28 so that the O-ring is interposed between the flange part 28 and the lid-side inner peripheral wall part 45. In the case of such a configuration, the internal space S2 is airtightly sealed off from the outside.

<Regarding the Operation of the Chain Block>

The operation of lifting and lowering the cargo using the chain block 10 with the above configuration will be described. In the case of lifting the cargo by the above-described chain block 10, when the handchain C2 is operated in the hoisting direction with the cargo hooked on the lower hook 120, the handwheel 101 rotates, and the female thread member 102 of the torque limiter mechanism 103 also rotates together with the handwheel 101. Then, by the screw action of the female thread part 102*d* of the female thread member 102 and the male thread part 91*c* of the brake receiver 91, the flange part 102*a* brings the brake discs 92 and the ratchet wheel 93 into pressure contact. Then, the female thread member 102 and the brake receiver 91 integrally rotate.

Then, by the spline engagement of the spline part 91*b*3 and the spline part 63, the driving force is transmitted from the brake receiver 91 to the drive shaft 60, and then transmitted through the pinion gear 62, the large-diameter gears 72, and the small-diameter gears 73 to the load gear 74 to rotate the load sheave hollow shaft 50. Thus, the load chain C1 is hoisted, whereby the cargo lifted.

In contrast to the above, in the case of lowering the hoisted cargo, the handchain C2 is sent in an opposite direction to that at the time when lifting the cargo. Then, the handwheel 101 comes to loosen the pressure contact to the brake discs 92. According to the amount of the loosening, the drive shaft 60 rotates in a direction opposite to the cargo hoisting direction. This gradually lowers the cargo.

Note that in a stop state of the ratchet wheel 93, the tip of the pawl member 94 meshes with a pawl part (not illustrated) of the ratchet wheel 93. In addition, even if a hand is released from the handchain C2 at the time of hoisting to try to reversely rotate the drive shaft 60 by the gravity acting thereon from of the cargo, the brake disc 92 is pressed against the ratchet wheel 93 by the handwheel 101 in the state where the handwheel 101 is not rotated, and the brake disc 92 is pressed against the flange part 91*a* of the brake receiver 91 by the ratchet wheel 93. This applies the brake force against the gravity of the cargo to prevent the cargo from lowering.

<Regarding the Improvement in Stiffness of the Main Body Frame and the Improvement in Meshing Accuracy of the Gear Part (Effect)>

In the above-described chain block 10, a large load acts on the main body frame 20 at the time of suspending a cargo. Therefore, deformation occurs in the bottom part 23*a* or the outer peripheral wall part 23*b*, and the deformation may vary the mesh between the gear portions. In particular, one end side of the reduction gear member 71 is supported by the bearing B1 fitted in the bearing fixing hole 41 of the gear cover 40 and another end side thereof is supported by the shaft hole P2*a* of the bearing plate P2. Therefore, if the deformation occurs in the bottom part 23*a* or the outer peripheral wall part 23*b*, positional change occurs in the reduction gear member 71 to change the meshing state of the gear portions.

Further, one end side of the reduction gear member 71 is rotatably supported by the bearing B1 fitted in the bearing fixing hole 41 of the gear cover 40, and the gear cover 40 is fixed to the main body frame 20 by bolts SB2. However, when the above-described deformation of the outer peripheral wall part 23*b* occurs, the positions of the bolts SB2 change relatively to the main body frame 20. This also changes the attachment positions on the one end side of the reduction gear members 71 to change the meshing state of the gear portions.

When such deformation of the main body frame 20 occurs to change the meshing state of the gear portions, mechanical loss increases. This decreases the efficiency of the chain block 10. The increase in mechanical loss also shortens the lifetime of the chain block 10.

However, in this embodiment, the upper rib 261 is provided on the upper side of the internal space S2 of the gear-side frame part 23 and on a side nearer the center of the internal space S2 than is the outer peripheral wall part 23*b*. Therefore, it becomes possible to improve the stiffness of the main body frame 20 (gear-side frame part 23), thereby making the main body frame 20 (the gear-side frame part 23) resistance to deformation. In particular, in this embodiment, the upper rib 261 and the outer peripheral wall part 23*b* on the upper side than is the upper rib 261 form a box structure having the upper space part S21 therein. The formation of the box structure makes it possible to improve the strength much more than the cylindrical structure surrounded only by the outer peripheral wall part 23*b*.

Further, the improvement in stiffness of the main body frame 20 can suppress change of the meshing state of the gear portions. This makes it possible to prevent an increase in mechanical loss due to the change of the meshing state of the gear portions and thereby prevent a decrease in efficiency of the chain block 10. Further, it is possible to prevent the increase in mechanical loss and therefore increase the lifetime of the chain block 10.

Further, the upper rib 261 is provided adjacent to the insertion hole 24 into which the link shaft 111 located on the upper side is inserted, and both end sides of the upper rib 261 are coupled to the outer peripheral wall part 23*b*. Here, at the time of suspending the cargo, a large load acts on the main body frame 20 near the link shaft 111. In particular, the insertion hole 24 for inserting the link shaft 111 thereinto of the main body frame 20 is provided not so long in peripheral length, and therefore stress concentration is apt to occur in the insertion hole 24 or at the bottom part 23*a* near the insertion hole 24 or the like. However, the upper rib 261 provided adjacent to the insertion hole 24 can resist such stress concentration and thereby suppress the deformation of the main body frame 20.

Further, in this embodiment, the gear cover 40 is attached to the main body frame 20 by two bolts SB2 (fixing means) on the upper side, and the two bolts SB2 are provided adjacent to both end sides of the upper rib 261 respectively. Therefore, the stiffness of the fixed portions of the bolts SB2 can be increased, and thereby can suppress relative change of the positions of the bolts SB2 with respect to the main body frame 20. This can prevent the positions of the bearing fixing holes 41 and the bearings B1 on the gear cover 40 side from varying with respect to the gear-side frame part 23, and thereby suppress the change of the meshing state of the gear portions.

Further, in this embodiment, the lower rib 262 is provided on a side nearer the center of the internal space S2 on the lower side of the upper rib 261 than is the lower outer peripheral wall part 23*b*. Therefore, it is possible to further increase the stiffness of the main body frame 20 (the gear-side frame part 23).

In particular, in this embodiment, the upper rib 261, the lower rib 262, and the outer peripheral wall part 23*b*1 located between them constitute the inner peripheral wall part 27, and the gear-side frame part 23 therefore has a structure having a double wall portion and can further increase the stiffness. Further, the inner peripheral wall part 27 is provided in an elliptical shape in plan view. Therefore, the inner side of the inner peripheral wall part 27 can be formed in a shape suitable for housing the gear portions including the pair of reduction gear members 71 as the gear housing space part S23. Further, the inner peripheral side of the inner peripheral wall part 27 has a smooth shape and can therefore prevent formation of a place where stress concentration occurs.

Further, the insertion hole 24 for the link shaft 111 is opened in the upper space part S21, and therefore if dust, water droplet or the like enters from the outside through a slight gap between the link shaft 111 and the insertion hole 24, they are received in the upper space part S21, so that dust, water droplet or the like is difficult to enter the gear housing space part S23. Therefore, the gear housing space part S23 is a preferable form as the gear housing part. Further, it is possible to similarly prevent entrance of water droplet or the like from above the gear-side frame part 23 from which water droplet such as rain water or the like easily enters, by the outer peripheral wall part 23*b*, the upper rib 261, the lid-side outer peripheral wall part 43 and the lid-side upper rib 431.

Further, the provision of the inner peripheral wall part 27 having the lower rib 262 makes it difficult for grease to leak to the outside. In particular, in the state where the chain block 10 is suspended, grease gradually leaks downward, but the provision of the inner peripheral wall part 27 having the lower rib 262 can suppress the leakage of grease. Further, in this embodiment, the lower rib 262 and the outer peripheral wall part 23*b* on the side lower than is the lower rib 262 form a box structure having the lower space part S22 therein. The formation of the box structure makes it possible to receive grease by the box structure even if grease leaks to the side lower than the lower rib 262, and thereby more surely prevent the leakage of grease to the outside.

Further, in this embodiment, the upper rib 261 constituting the inner peripheral wall part 27, the lower rib 262 constituting the inner peripheral wall part 27, and the outer peripheral wall part 23*b*1 located between the upper rib 261 and the lower rib 271, are provided to be flush with one another. This facilitates formation of the end surfaces 261*a*, 262*a*, 23*b*2 side of the gear-side frame part 23. In particular, in the case of employing a configuration provided with no flange part 28, the formation of an end surface 27*b* becomes easy.

Further, from the end surface 27*b*, the flange part 28 projects to the gear cover 40 side, and the flange part 28 is provided in an elliptical shape in plan view. Further, the gear cover 40 is provided with the lid-side upper rib 431, the lid-side outer peripheral wall part 43, and the lid-side lower rib 432, which abut on the upper rib 261, the outer peripheral wall part 23*b*1, and the lower rib 262, respectively. In addition, the flange part 28 is located on a side inner than is the inner wall surface 45*a* of the lid-side inner peripheral wall part 45. Therefore, the flange part 28 coming into abutment on the inner wall surface 45*a* facilitates positioning of the gear cover 40 with respect to the main body frame 20. In particular, if the gear cover 40 tries to rotate with respect to the main body frame 20, the flange part 28 bumping into the inner wall surface 45*a* disables the rotation, facilitates the positioning of the gear cover 40 with respect to the main body frame 20, and facilitates assembly of the chain block 10.

Further, the provision of the upper rib 261 and the lower rib 262 at the gear-side frame part 23 and the provision of the lid-side upper rib 431 and the lid-side lower rib 432 at the gear cover 40 can increase the contact area between the gear-side frame part 23 and the gear cover 40. This makes the gear cover 40 and the main body frame 20 resistance to deformation even when an impact is applied thereon from the outside.

Further, in this embodiment, a configuration may be employed in which a sealing member such as an O-ring is provided on the outer peripheral side of the flange part 28. In such a configuration, the internal space S2 is airtightly sealed off from the outside. Further, it becomes possible to more surely prevent grease from leaking to the outside.

Regarding Other Embodiments (a Second Embodiment and a Third Embodiment)

Subsequently, other embodiments (a second embodiment and a third embodiment) of the above-described chain block 10 will be described. Note that the chain block 10 in the second embodiment and the chain block 10 in the third embodiment are common with the chain block 10 in the first embodiment in the configuration other than portions described below.

FIG. 9 is a view illustrating the configuration of the chain block 10 according to the second embodiment, and is a cross-sectional view illustrating a state where the chain block 10 is cut along the line III-III in FIG. 1. As illustrated in FIG. 9, in the chain block 10 in the second embodiment, the inner wall surface 45*a* of the lid-side inner peripheral wall part 45 is provided in a tapered shape inclined with respect to the X-direction as illustrated in FIG. 9. Further, between the inner wall surface 45*a* and the outer peripheral side of the flange part 28, a space part S3 is formed (the same configuration also in FIG. 3). The tapered shape of the inner wall surface 45*a* may be realized, for example, by chamfering a corner portion on the inner wall surface 45*a* side of the lid-side inner peripheral wall part 45, and the inner wall surface 45*a* may have a desired angle other than 45 degrees.

In this space part S3, a sealing member 29 such as an O-ring is provided. The sealing member 29 such as an O-ring is brought into a pressed state between the inner wall surface 45*a* and the flange part 28 to be able to prevent liquid such as water or oil, dust or the like from entering the gear housing space part S23 through them. This forms a configuration suitable for an environment in which the sealing degree of the gear housing space part S23 needs to be enhanced. It also is possible to more surely prevent leakage of grease to the outside.

FIG. 10 is a view illustrating the configuration of the chain block 10 according to the third embodiment, and is a cross-sectional view illustrating a state where the chain block 10 is cut along the line III-III in FIG. 1. As illustrated in FIG. 10, in the chain block 10 in the third embodiment, the inner wall surface 45*a* of the lid-side inner peripheral wall part 45 does not employ the tapered shape as illustrated in FIG. 9. Therefore, the sealing member 29 such as an O-ring is not arranged. Instead of arranging the sealing member 29, the inner wall surface 45*a* of the lid-side inner peripheral wall part 45 and the outer peripheral surface of the flange part 28 are attached by fit in the configuration illustrated in FIG. 10.

Such fit may be clearance fit or intermediate fit. Besides, the fit may be interference fit using a method of press fit or the like.

In the case of employing the fit, at the corner portion on the inner wall surface 45*a* of the lid-side inner peripheral wall part 45, the chamfering dimension thereof is provided to be smaller than that in the configuration illustrated in FIG. 9. Note that a configuration may be employed, in which a tapered portion inclined at an angle much smaller than 45 degrees with respect to the X-direction is provided on the out peripheral surface of the flange part 28, and any portion of the inner wall surface 45*a* is in contact with the tapered portion. Further, a configuration may be employed in which an inclined angle of the inner wall surface 45*a* with respect to the X-direction is made an angle much smaller than 45 degrees, and any portion of the inner wall surface 45*a* is in contact with the flange part 28.

In the chain block 10 in the third embodiment, the inner wall surface 45*a* of the lid-side inner peripheral wall part 45 and the outer peripheral surface of the flange part 28 are attached by fit, thereby making it possible to increase the attaching accuracy of the gear cover 40 to the main body frame 20. This makes it possible to increase the mechanical efficiency including the mesh of the gears (the reduction gear members 71, the large-diameter gears 72 and so on) constituting the reduction mechanism 70, and the pinion gear 62. Besides, the positional restriction is implemented at a portion apt to bend such as a relatively tip side of the thin flange part 28 in the chain block 10 in the first embodiment, whereas the positional restriction can be implemented on a side nearer the base than is the tip side of the flange part 28 in the chain block 10 in the third embodiment. This makes it possible to increase the effect of the positional restriction.

Modification Examples

The embodiments of the present invention have been described, and the present invention is variously modified in addition to them. Hereinafter, they will be described.

In the above embodiments, the inner peripheral wall part 27 is provided in an elliptical shape in plan view. However, the shape of the inner peripheral wall part 27 in plan view is not limited to the elliptical shape but may be, for example, an oval shape, a rectangular shape, or another shape. Similarly, the shapes of the flange part 28 and the lid-side inner peripheral wall part 45 in plan view may be, for example, an oval shape, a rectangular shape, or another shape.

Further, in the above embodiments, the configuration in which the gear cover 40 is attached to the main body frame 20 by four bolts SB2 is illustrated. However, the number of the bolts SB2 may be any number. Note that the bolts SB2 are preferably provided on both end sides of the upper rib 261 respectively, but a configuration may be employed in which the bolts SB2 exist at portions distant from both end sides of the upper rib 261.

The invention claimed is:

1. A chain block capable of moving a cargo in a vertical direction by transmitting driving force of a handwheel through a drive shaft and a reduction gear member to a load sheave member so as to hoist and lower a load chain wound around the load sheave member, the chain block comprising:

a main body frame that has a gear-side frame part housing the reduction gear member and directly or indirectly supporting one end side of the reduction gear member in a rotatable state;

a gear cover that is attached to the main body frame by a fixing means to form an internal space sealed off from an outside between the gear cover and the main body frame, and rotatably supports the one end side of the reduction gear member; and an upper hook that is coupled to the gear side-frame part via a connecting means, for suspending the main body frame from the upper hook, wherein the gear-side frame part is provided with a bottom part and an outer peripheral wall part projecting away from an outer peripheral edge portion of the bottom part in an axial direction of the drive shaft, and an upper rib which is unitary with and extends from opposite portions of the outer peripheral wall part with reference to the upper rib is provided at the gear-side frame part on an upper side where the connecting means is provided such that a distance between the upper rib and the drive shaft is shorter than is a distance between the outer peripheral wall part and the drive shaft, and the upper rib is provided adjacent to the connecting means wherein a lower rib which is unitary with and extends from opposite portions of the outer peripheral wall part with reference to the lower rib is provided at a portion of the gear-side frame on a lower side in the vertical direction distant from the connecting means in a suspending direction such that a distance between the lower rib and the drive shaft is shorter than is a distance between the outer peripheral wall part and the drive shaft, and wherein an inner peripheral wall part including the upper rib and the lower rib; and the outer peripheral wall part located between the upper rib and the lower rib is provided in an elliptical shape or an oval shape in plan view.

2. The chain block according to claim 1, wherein the fixing means is one of at least two fixing means;

wherein the gear cover is attached to the main body frame by at the least two fixing means on an upper side in the vertical direction in a suspending state, and wherein two of the fixing means are provided adjacent to both end sides of the upper rib.

3. The chain block according to claim 1, wherein end surfaces on the gear cover side of the upper rib, the lower rib, and the outer peripheral wall part located between the upper rib and the lower rib, the upper rib, the lower rib and the outer peripheral wall part constituting the inner peripheral wall part, are provided to be flush with one another, wherein a flange part projects from the end surfaces to the gear cover side, and the flange part is provided in an elliptical shape or an oval shape in plan view, wherein the gear cover is provided with a lid-side upper rib abutting on the upper rib, a lid-side outer peripheral wall part abutting on the outer peripheral wall part, and a lid-side lower rib abutting on the lower rib, and wherein the flange part is located on a side inner than is an inner wall surface of the lid-side inner peripheral wall part constituted of the lid-side upper rib, the lid-side lower rib, and the lid-side outer peripheral wall part located between the lid-side upper rib and the lid-side lower rib.

4. The chain block according to claim 3, wherein an annular sealing member is arranged on an outer peripheral side of the flange part, and wherein the sealing member is located between the flange part and the inner wall surface of the lid-side inner peripheral wall part.

5. The chain block according to claim 2, wherein a lower rib which is unitary with and extends from opposite portions of the outer peripheral wall part with reference to the lower rib is provided at a portion of the gear-side frame on a lower side in the vertical direction distant from the connecting means in a suspending direction such that a distance between the lower rib and the drive shaft is shorter than is a distance between the outer peripheral wall part and the drive shaft, and wherein an inner peripheral wall part constituted including of the upper rib, the lower rib, and the outer peripheral wall part located between the upper rib and the lower rib is provided in an elliptical shape or an oval shape in planar plan view.

6. The chain block according to claim 5, wherein end surfaces on the gear cover side of the upper rib, the lower rib, and the outer peripheral wall part located between the upper rib and the lower rib, the upper rib, the lower rib and the outer peripheral wall part constituting the inner peripheral wall part, are provided to be flush with one another, wherein a flange part projects from the end surfaces to the gear cover side, and the flange part is provided in an elliptical shape or an oval shape in planar plan view, wherein the gear cover is provided with a lid-side upper rib abutting on the upper rib, a lid-side outer peripheral wall part abutting on the outer peripheral wall part, and a lid-side lower rib abutting on the lower rib, and wherein the flange part is located on a side inner than is an inner wall surface of the lid-side inner peripheral wall part constituted of the lid-side upper rib, the lid-side lower rib, and the lid-side outer peripheral wall part located between the lid-side upper rib and the lid-side lower rib.

7. The chain block according to claim 6, wherein an annular sealing member is arranged on an outer peripheral side of the flange part, and wherein the sealing member is located between the flange part and the inner wall surface of the lid-side inner peripheral wall part.

8. A chain block capable of moving a cargo in a vertical direction by transmitting driving force of a handwheel through a drive shaft and a reduction gear member to a load sheave member so as to hoist and lower a load chain wound around the load sheave member, the chain block comprising:

a main body frame that has a gear-side frame part housing the reduction gear member and directly or indirectly supporting one end side of the reduction gear member in a rotatable state;

a gear cover that is attached to the main body frame by a fixing means to form an internal space sealed off from an outside between the gear cover and the main body frame, and rotatably supports the one end side of the reduction gear member; and an upper hook that is coupled to the gear side-frame part via a connecting means, for suspending the main body frame from the upper hook, the gear-side frame part is provided with a bottom part and an outer peripheral wall part projecting from an outer peripheral edge portion of the bottom part, and an upper rib which is unitary with and extends from opposite portions of the outer peripheral wall part with reference to the upper rib is provided at the gear-side frame part on an upper side where the connecting means is provided such that a distance between the upper rib and the drive shaft is shorter than a distance between the outer peripheral wall part and the drive shaft, and the upper rib is provided adjacent to the connecting means;

wherein a lower rib which is unitary with and extends from opposite portions of the outer peripheral wall part with reference to the lower rib is provided at the gear-side frame part on a lower side in the vertical direction distant from the connecting means in a suspending direction such that a distance between the lower rib and the drive shaft is shorter than a distance between the outer peripheral wall part and the driver shaft, and wherein an inner peripheral wall part including the upper rib and the lower rib; and the outer peripheral wall part located between the upper rib and the lower rib is provided in an elliptical shape or an oval shape in plan view.

* * * * *